US005819494A

United States Patent [19]

Haisch

[11] Patent Number: 5,819,494

[45] Date of Patent: Oct. 13, 1998

[54] TRUSS CONNECTOR STRUCTURE

[76] Inventor: Douglas C. Haisch, 1800 S. Barney St., Anderson, Calif. 96007

[21] Appl. No.: 874,981

[22] Filed: Jun. 13, 1997

[51] Int. Cl.[6] ..... E04C 3/02

[52] U.S. Cl. ..... 52/696; 52/713; 52/655.1; 411/469; 403/283

[58] Field of Search ..... 403/283, 405.1; 52/696, 654.1, 655.1, 656.1, 712, 713, 639, 690, 691, 656.9; 411/461, 466, 469

[56] References Cited

U.S. PATENT DOCUMENTS 3,304,106 2/1967 McCormack .
3,347,126 10/1967 Templin et al. .
3,498,170 3/1970 Sanford .
3,501,181 3/1970 Jureit .
3,667,337 6/1972 Burke .
5,006,006 4/1991 Lehtonen ..... 403/283
5,622,022 4/1997 Haisch ..... 52/696 X

*Primary Examiner*—Creighton Smith
*Attorney, Agent, or Firm*—Theodore J. Bielen, Jr.

[57] ABSTRACT

A truss connector utilizing a first relatively flexible plate which has a first side and an opposite second side. A plurality of teeth extend from the second side of the first relatively flexible plate and are capable of penetrating the truss, which may be composed of softer material such as wood and the like. The second relatively rigid plate is fixed to the flexible plate such that the first side of the rigid plate contacts the second side of the flexible plate to form a unit. Apertures pass through the connected first and second plates to accept fasteners which bear on the relatively rigid plate and are capable of passing through the truss. Pairs of connectors may be employed in a truss assembly.

5 Claims, 2 Drawing Sheets

TRUSS CONNECTOR STRUCTURE

BACKGROUND OF THE INVENTION

The present invention relates to a novel truss connector structure.

Plates have often been used to reinforce or connect wooden structural members together in side-by-side or abutting configurations. For example, metallic plates have been employed to span the joint between two wooden members and have been nailed or bolted to the wooden members to keep them together.

In addition, plates having teeth have also been used to span the joint between wooden members which are intended to be connected together. These latter arrangements, although they provide connection between the wooden members, is usually relatively weak and unable to withstand shear stress applied to wooden structures such as trusses.

U.S. Pat. Nos. 3,304,106, 3,347,126, and 3,667,337 describe grip plates for wooden truss members that employ plates having teeth of various configurations. Such structures are of limited value under the load applied to truss structures in buildings.

U.S. Pat. No. 3,501,181 describes a decorative structural wooden joint in which a toothed plate is covered by a decorative plate and tacked into place to cover a joint between two wooden members for aesthetic purposes only.

U.S. Pat. No. 3,498,170 shows a toothed plate which is used in combination with an underlying grommet plate of essentially the same gage as the toothed plate. The grommet plate possesses openings to receive the teeth from the top plate and to prevent movement between the toothed plate and the grommet plate. Thus, the teeth are aided in their gripping of the wooden members.

A truss connector structure which employs a toothed plate and yet is far stronger than any toothed plate or toothed plate combination heretofore proposed for use in reinforcing truss structures, would be a notable advance in the building industries.

SUMMARY OF THE INVENTION

In accordance with the present invention a novel and useful truss connector is herein provided.

The connector of the present invention utilizes a first relatively flexible plate having a first side and an opposite second side. A plurality of teeth extend from the second side of the flexible plate and are capable of penetrating the truss which is typically formed of wood. It should be noted, that the truss may also be formed of composite material, plastic material and the like. In any case, the teeth of the first plate are capable of penetrating whatever material is employed for the truss structures. A second relatively rigid plate is also included in the present invention and possesses a first side and an opposite second side. Connection means is employed for fixing the first side of the relatively flexible plate to the first side of the relatively rigid plate. The rigid plate may be formed of material having a larger gage than the flexible plate having the penetrating teeth. In certain instances, connection means may take the form of a weld or a series of spot welds between the plates. In other cases, the connection means may also take the form of a fastener, such as a nut and bolt, which is capable of passing through both plates as well as the truss member itself.

In this regard, the first and second plates form a connector unit which exhibits great strength in the connection of truss members in a typical truss structure. Moreover, apertures are employed which pass through the connector unit and through the truss member. In many cases, a pair of connector units are employed on either side of the joint of the truss unit such that the apertures through the connector units and the truss members are aligned to hold a pair of connector units in compression on either side of the truss members. A fastener is normally employed to accomplish this task and is capable of passing through the apertures formed in the connector units and the truss member. Such fastener may take the form of a nut and bolt or other suitable connectors. Of course, a plurality of such connectors may be used with a pair of connector units on a truss structure. It has been found that connector of the present invention is far superior in resisting shear stress than prior art devices.

It may be apparent that a novel and useful truss connector has been described hereinabove.

It is therefore an object of the present invention to provide a truss connector which is capable of connecting joints in a truss structure and maintaining those joints in an integral fashion upon the application of stress forces.

Another object of the present invention is to provide a truss connector which is relatively simple to manufacture and install in a truss joint.

Another object of the present invention is to provide a truss connector which utilizes the superior penetration ability of a thin piece of material without destroying the integrity of a wooden structure and the strength of a relatively rigid member forming a portion of a truss connector unit.

Yet another object of the present invention is to provide a truss connector which may be employed in truss systems that are formed in parts and assembled on the site.

The invention possesses other objects and advantages especially as concerns particular characteristics and features thereof which will become apparent as the specification continues.

Figure 1:
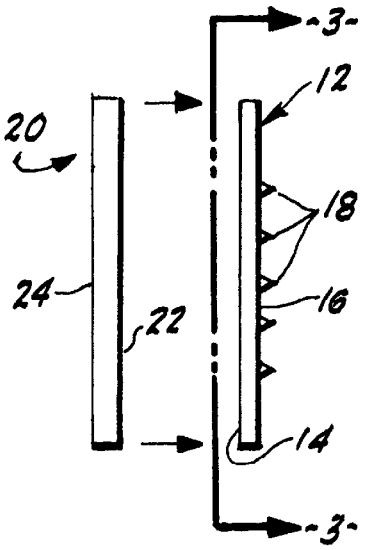
FIG. 1 is a side elevational view of the basic two elements forming the connector unit of the present invention.

For a better understanding of the invention reference is made to the following detailed description of the preferred embodiments thereof which should be taken in conjunction with the hereinbefore described drawings.

DETAILED DESCRIPTION OF THE PREFERRED EMBODIMENTS

For a better understanding of the invention references made to the hereinabove described drawings which should be taken in conjunction with the following detailed description.

The invention as a whole is depicted in the drawings by reference character 10. Truss connector 10 includes as one of its elements a first relatively flexible plate 12. Plate 12 includes a first side 14 and a second side 16. A plurality of teeth 18 extend from second side 16 of plate 12. Plurality of teeth 18 may be of any configuration which is known to be capable of penetrating material such as wood which is a typical construction material for a truss.

Second relatively rigid plate 20 is also employed in the present invention. Plate 20 may be formed of any suitable material such as steel, aluminum, and the like. In any case, second relatively rigid plate is normally of a thicker gage and of a stiffer construction than first flexible plate 12. The second plate 20 has a first side 22 and an opposite second side 24.

Figure 2:
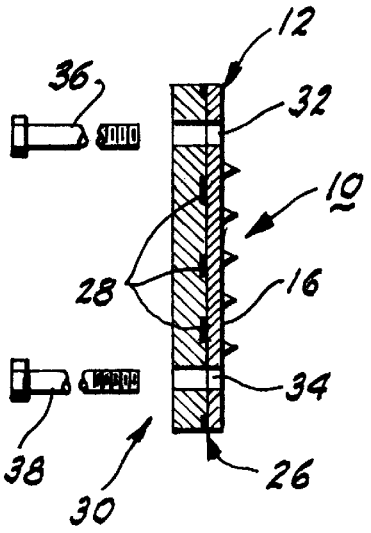
FIG. 2 is a sectional view of a connector partially formed connector unit showing a pair of bolts in section and in part, aligned with the apertures through the connector unit.

Turning to FIG. 2, it may be observed that connection means 26 is shown for fixing first plate 12 to second plate 20. Such connection means 26 may take the form of a plurality of spot welds 28 fixing first side 14 of the first plate 12 to first side 14 of rigid plate 20. Thus, connection means 26 is employed to form a connector unit 30 which may be used as a truss connector by overlapping joints within a truss structure. In addition, apertures, such as apertures 32 and 34, may be found in the connector unit 30. Apertures 32 and 34 accept bolts 36 and 38, which may be used with threaded nuts (not shown) to hold connector unit 30 to a truss structure, which will be described hereinafter. Without the use of spot welds, connection means 26 may simply take the form of fasteners such as bolts 36 and 38. This aspect of the present invention will be more fully described in regard to FIGS. 3 and 4 which illustrate a truss unit which is to be assembled at the site of use.

Figure 3:
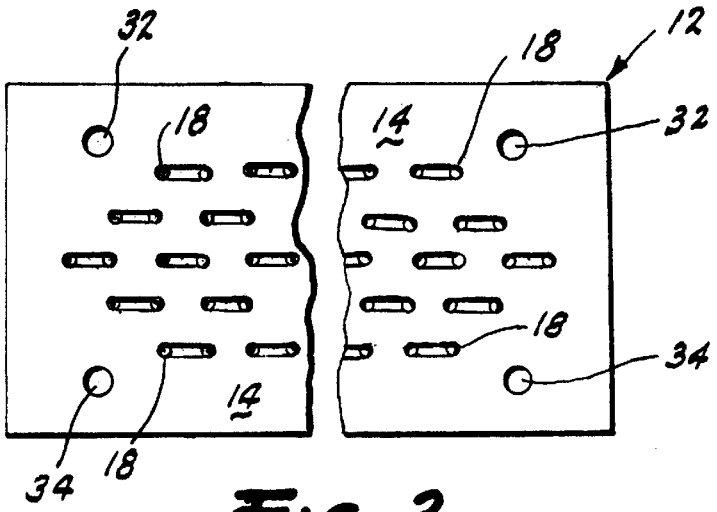
FIG. 3 is a partial bottom plan view of the connector unit of FIG. 2.
Figure 2A:
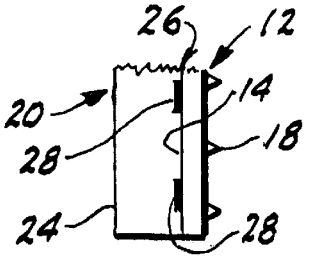
FIG. 2A is a partial end view of the connector unit of FIG. 2.

FIG. 3 illustrates the plurality of teeth 18 which may be punched through flexible plate 12 leaving a slot and a pair of teeth at either end of the slot. Thus, the connector unit 30 described in FIGS. 1–3 is a unitary member formed by the use of spot welds 28, and is employed to form a truss which is normally not disassembled before use.

Figure 4:
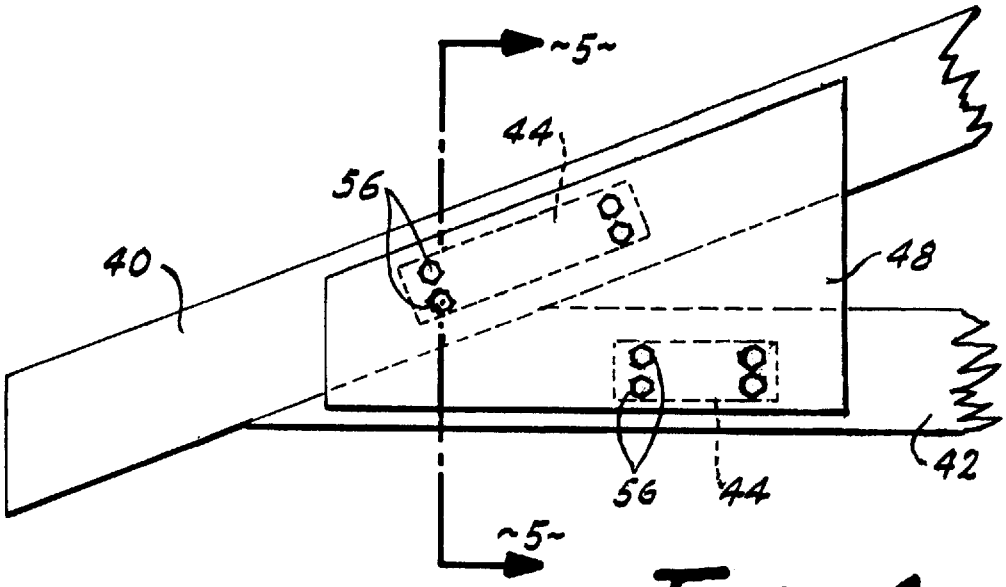
FIG. 4 is a side elevational view of another embodiment of the present invention utilizing toothed plates and rigid plates which are separable and reassembled at the site of ultimate use.
Figure 5:
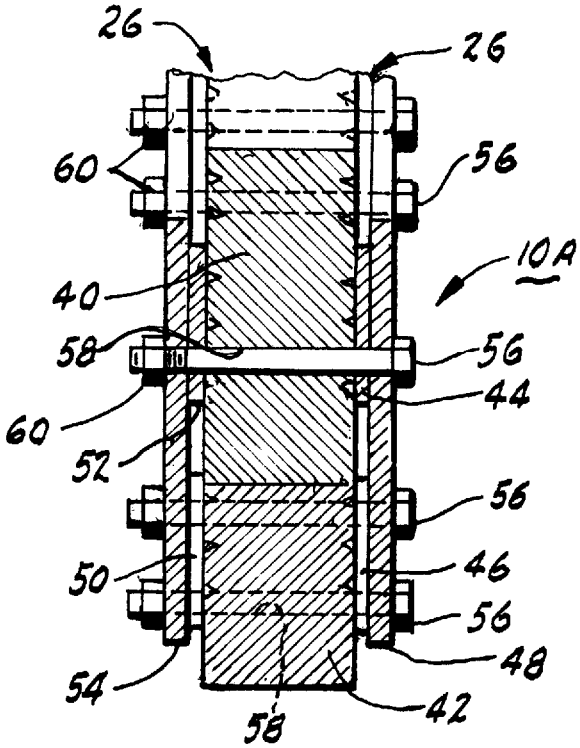
FIG. 5 is a sectional view taken along line 4—4 of FIG. 3.

Turning now to FIGS. 4 and 5, it may be observed that connector unit 10A are used with truss members 40 and 42 are depicted. Members 40 and 42 form a corner of a truss structure and are connected by toothed plates 44 and 46 which are overlain by a rigid plate 48. A similar set of toothed plates 50 and 52 are found on the other side of truss members 40 and 42 from the position of plates 44 and 46. An overlying rigid plate 54 is employed in a similar manner with respect to rigid plate 48. A plurality of bolts 56 pass through a plurality of apertures 58 which extend through members 40 and 42 as well as plates 44, 46, 48, 50, 52, and 54. Cooperative nuts 60 thread to bolts 56 and hold the above-identified plates and members 40 and 42 in compression. Thus, connection means 26 takes the form of a plurality of bolts 56, instead of a spot weld system depicted in FIGS. 1–3. The latter embodiment 10A of the present invention is especially useful in trusses that are to be assembled at the site for use.

The following example is presented to illustrate the invention but is not deemed to limit it in any manner.

EXAMPLE I

Two connector plates as depicted in FIGS. 1–3 of the present application, were formed into 3 inch by 6 inch connector units. The connector units were pressed onto 4 inch by 4 inch wood studs on opposite sides of the studs without bolts. Another identical set of plates was used with an identical 4 by 4 stud connection, except that two, 3¼ inch diameter, 5 inch long bolts were placed through the plates and the studs with cooperative nuts that were not tightened. A Tinius Olson Supper "L" U.T.M. 400,000 pound capacity low testing device was employed. Three items in each set was used in the following tests.

In set one, using the connector unit of FIGS. 1–3 without bolts, a failure occurred at 29,000 pounds, twice, and at 33,500 pounds, once in three tests.

Utilizing set two, where bolts were loosely passed through the connector unit of FIGS. 1–3, failure was induced at the plates at 32,000 pounds in one test. Another test induced a failure at one of the two plate welds at 35,000 pounds. However, the bolts in this test held as the load climbed to 40,500 pounds. Finally, failure was induced in the wood at 34,600 pounds in the third test. In the latter test, the bolts held as the load climbed to 36,000 pounds.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A connector for a truss comprising:

a. a first relatively flexible plate having a first side and an opposite second side, a plurality of teeth extending from said second side of said first relatively flexible plate, said teeth penetrating the truss;

b. a second relatively rigid plate having a first side and an opposite second side;

c. connection means for fixing said first relatively flexible plate first side to said second relatively rigid plate first side, to form a connector unit;

d. an aperture passing through said first flexible plate and said second rigid plate; and e. a fastener passing through said aperture of said connected first and second plates and the truss, said fastener including means for compressing said connector unit to the truss, said means for compressing said connector unit including a fastener passing completely through the truss.

2. The truss connector of claim 1 in which said aperture comprises a first aperture and which additionally comprises a second aperture passing through said first, relatively flexible plate and said second relatively rigid plate, and said fastener comprises a first fastener and which additionally comprises a second fastener passing through said second aperture and the truss.

3. The truss connector of claim 1 in which said connection means comprises a weld.

4. The truss connector of claim 1 in which said connection means comprises a fastener.

5. The truss connector of claim 1 in which said fastener comprises a nut and bolt.

* * * * *